US007383795B2

(12) United States Patent
Lawrence et al.

(10) Patent No.: US 7,383,795 B2
(45) Date of Patent: Jun. 10, 2008

(54) SURGE TANK

(75) Inventors: Patrick N. Lawrence, Wilsonville, OR (US); Frederick W. Menche, Portland, OR (US); Antonio Edgar, Portland, OR (US)

(73) Assignee: Daimler Trucks North America LLC, Portland, OR (US)

( * ) Notice: Subject to any disclaimer, the term of this patent is extended or adjusted under 35 U.S.C. 154(b) by 0 days.

(21) Appl. No.: 11/512,665

(22) Filed: Aug. 29, 2006

(65) Prior Publication Data

US 2007/0215073 A1 Sep. 20, 2007

Related U.S. Application Data

(60) Provisional application No. 60/783,214, filed on Mar. 16, 2006.

(51) Int. Cl.
*F01P 3/22* (2006.01)
*F01P 3/20* (2006.01)

(52) U.S. Cl. ..... 123/41.54; 123/41.51; 220/562; 220/563

(58) Field of Classification Search ..... 123/41.54, 123/41.51; 220/562, 563; 165/104.32, 41, 165/51

See application file for complete search history.

(56) References Cited

U.S. PATENT DOCUMENTS 4,723,596 A 2/1988 Spindelboeck et al.
5,111,776 A * 5/1992 Matsushiro et al. ..... 123/41.54
5,139,082 A 8/1992 McEachern, Jr.
5,329,889 A 7/1994 Caldwell
5,456,218 A 10/1995 Theorell
5,680,833 A 10/1997 Smith
6,216,646 B1 * 4/2001 Smith et al. ..... 123/41.51

FOREIGN PATENT DOCUMENTS

WO WO 2004/007924 * 1/2004

OTHER PUBLICATIONS

Drawings A-1, A-2 and A-3 are of a prior art plastic (polypropylene through which fluid levels are visible) surge tank first sold at least since 2002.

(Continued)

*Primary Examiner*—Stephen K. Cronin
*Assistant Examiner*—Ka Chun Leung
(74) *Attorney, Agent, or Firm*—Klarquist Sparkman, LLP

(57) ABSTRACT

A surge tank comprises a liquid inlet portion designed to dissipate the energy of coolant flowing into the surge tank. Desirably, fluid is delivered into a pool of liquid in an initial chamber rather than into an air gap above a pool of liquid such that the pool of liquid assists in dissipating energy of the entering coolant. Coolant from the last of a series of initial chambers desirably exits in a manner that reduces the distance air bubbles must rise to separate from the coolant. Also, when coolant flows from one initial chamber to at least one other initial chamber, desirably the direction of flow of at least a major volume of the coolant is changed, such as by locating an outlet passage from one chamber at a lower portion thereof and the passage from a subsequent chamber at an upper portion thereof. Passageways between the various chambers may be of a progressively increasing total cross-sectional area to assist in reducing the velocity of fluid flow from one chamber to the next. Also, in desirable embodiments, substantially laminar coolant flow is achieved prior to passage of coolant from an exiting chamber into a primary coolant receiving section of the surge tank.

23 Claims, 6 Drawing Sheets

OTHER PUBLICATIONS

Drawings B-1, B-2 and B-3 are of a prior art plastic (polypropylene through which fluid levels are visible) surge tank sold at least since 2003.

Drawings C-1, C-2 and C-3 are of a prior art plastic surge tank that was commercially available more than one year prior to the earliest priority date for the present application.

* cited by examiner

PRIOR ART

SURGE TANK

RELATED APPLICATION

This application claims the benefit of prior pending U.S. provisional patent application No. 60/783,214, filed Mar. 16, 2006, entitled, "Surge Tank", by Patrick N. Lawrence, Frederick W. Menche, and Antonio Edgar, which is hereby incorporated by reference.

TECHNICAL FIELD

The technology disclosed herein relates to surge tanks for use in vehicles and more particularly to surge tanks that receive coolant, such as from the engine and radiator of a vehicle, de-aerates the coolant, and returns the de-aerated coolant to the system, such as to the engine. The technology also relates to related methods.

BACKGROUND

With reference to FIG. 1, a schematic diagram of a simplified example of a vehicle having a surge tank for de-aerating coolant is illustrated. In FIG. 1, the vehicle 10 comprises an engine 12 and a radiator 14 through which coolant is circulated, at least at selected times, to cool the coolant for use in removing heat from the engine. Other components may also be cooled by the coolant such as a transmission 16 and an exhaust gas recirculation cooler (e.g., EGR cooler) not shown in this figure. The coolant may also be used to provide energy to or remove energy from an HVAC (heating ventilation and air conditioning) system of the vehicle. One specific example of a vehicle is a truck, such as a heavy duty or medium duty truck used in long hauling operations or a truck tractor used for such purposes. Land vehicles are particularly desirable applications in which such surge tanks would be used. In FIG. 1, segments of the coolant recirculation conduits are indicated by the numbers 18, 20 and 22. In the example of FIG. 1, aerated coolant from the engine passes via a conduit 24 to an inlet to a surge tank 26. In addition, aerated coolant passes through a conduit 28 from radiator 14 to an inlet to the surge tank 26, which may separate from or in common with the inlet that receives aerated fluid from conduit 24. Air is removed from the coolant as it passes through the surge tank 26. The de-aerated coolant is returned to the engine via a conduit 30 in FIG. 1.

There are a number of reasons for de-aerating coolant. For example, poor de-aeration of coolant can result in cavitation of an engine water pump, pitting of engine liners, engine overheating, cab HVAC system failures, EGR cooler erosion, and other drawbacks. Modern truck engines have relatively high fluid flow rates to a surge tank, such as in excess of four gallons per minute. As a result, it becomes more difficult to de-aerate the coolant. In addition, high fluid flow rates into a surge tank can result in fracturing air bubbles into microbubbles (e.g., pin sized bubbles) which are even more difficult to remove from the coolant.

It is known to make surge tanks out of plastic for weight and cost saving purposes. However, because of the high temperatures often reached by coolant, plastic can tend to soften when used. As a result, plastic surge tanks are typically provided with reinforcing baffles. However, high coolant flow rates into surge tanks with baffles increases the foaming (formation of small bubbles) when the entering liquid impacts the baffles. Also, because extremely small bubbles entrained in fluid are difficult to separate, bubbles formed from fracturing larger bubbles are more easily carried through a surge tank, resulting in poorer de-aeration of the coolant. To reduce the possibility of small foam formed bubbles entering the fluid and being carried through a surge tank, some engine manufacturers have issued specifications directing that fluid inlets to surge tanks be positioned above the level of fluid in the surge tank so that foam can escape into an air gap above the fluid level.

Other advantages of plastic surge tanks comprise the ability to make the surge tanks transparent or translucent for better visual inspection of fluid levels within the surge tanks, lower cost per piece and the fact that plastic can be molded readily into odd shapes.

A need exists for improved surge tank designs and related methods.

DETAILED DESCRIPTION

Figure 1:
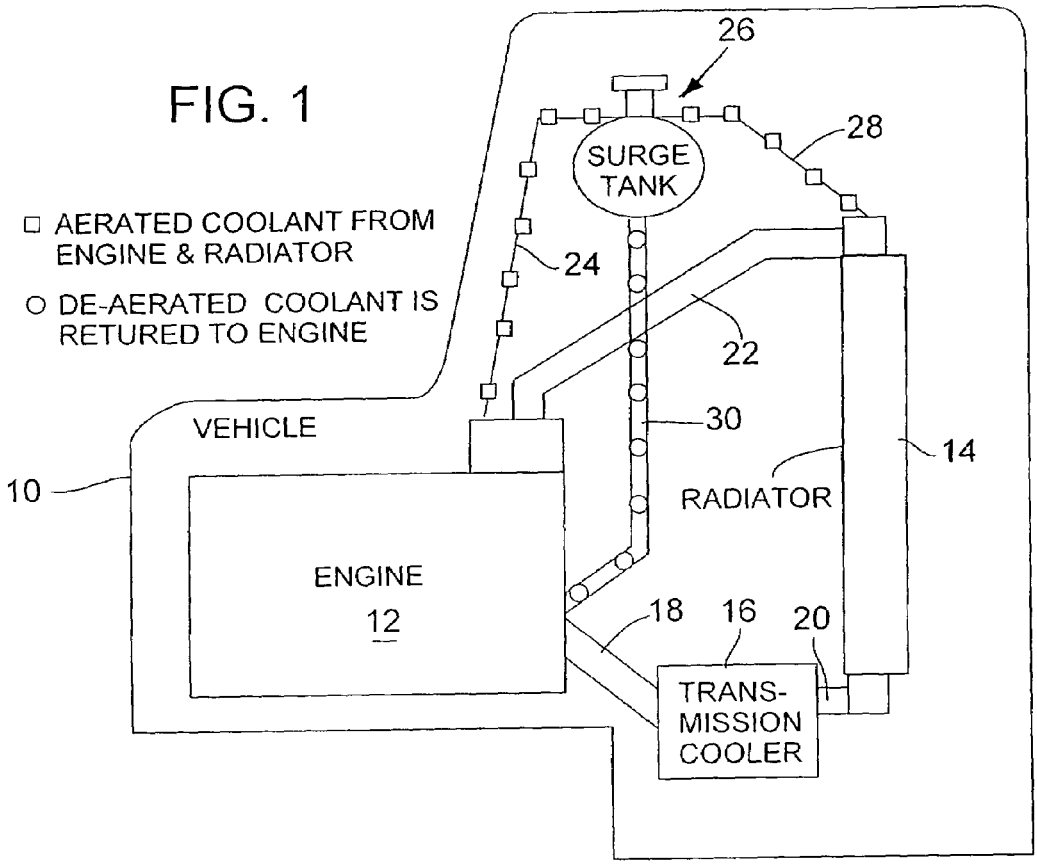
FIG. 1 is a simplified schematic diagram of one example of a vehicle system incorporating a surge tank.

In exemplary surge tanks in accordance with embodiments of this disclosure, it is desirable to provide a primary or settling fluid reservoir with enough air bubble receiving volume and an air gap above the liquid level to allow separation of air bubbles from the coolant. Also, it is desirable to allow air to escape the system during filling of the system. Typically, de-aerated air is shunted or vented from an air gap above the liquid level. Venting can be through a downwardly directed air passageway leading to a thermal expansion area and then upwardly to a vent in one specific example. In addition, when coolant is cold and the system is filled, it is desirable for the coolant holding reservoir to contain enough fluid to prevent air from being pulled through the air vent or shunt into the coolant system. In addition, it is desirable to have a tank with a volume that vents pockets of air present in the surge tank during initial filling, or that has enough excess capacity to receive the displaced air prior to venting. Also, when the surge tank is full and coolant is hot, it is desirable for the tank volume to have enough reserve capacity to allow expansion of the coolant as a result of heating, such as, for example, an expansion volume which is equal to a minimum of six percent of the total system coolant volume when the coolant is cold. These conditions can be varied in different embodiments.

In accordance with embodiments of the disclosed technology, it is desirable to regulate the coolant flow rate through the surge tank, to disperse the energy of incoming fluid so as to minimize or eliminate additional aeration of the coolant that could otherwise arise from foaming or the production of pin-sized bubbles as coolant flows through the surge tank. It is also desirable to disperse incoming fluid into a main reservoir or body of the surge tank in a manner that optimizes air and liquid separation.

In one desirable approach, a surge tank comprises a series of at least two chambers at or near one or more fluid inlets to the surge tank. Less desirably, the chambers can be positioned ahead of the surge tank and coupled thereto. Restrictions in these early or initial chambers regulate the tank flow and cause localized flooding (filling) of these chambers. In a desirable approach, once flooded, the incoming coolant is desirably injected into the coolant in a first chamber such that coolant in the first chamber assists in dispersing energy from the entering coolant. The turbulence of fluid flow is desirably reduced in these early chambers so that coolant flow becomes substantially laminar as the fluid passes through these chambers. The exit or outlet from these initial chambers is desirably adjacent to the top of the last of the chambers and more desirably adjacent to the top of a primary holding tank portion surface so as to minimize the distance air bubbles must rise through liquid for air separation. One or more intermediate chambers can also be included. In one desirable embodiment, there is one such intermediate chamber so that three initial chambers are provided.

A surge tank in accordance with embodiments disclosed herein accommodates engines of various types. A surge tank, in accordance with FIGS. 1-4 has been tested on Detroit Diesel Corporation engine Model DDCS60 and on a Mercedes Benz engine Model MBE4000. Thus, the surge tank technology can be used with a variety of engines and minimizes performance sensitivity to engine water pump flow rates so as to accommodate increased cooling requirements of newer truck engines without compromising surge tank functionality.

Although a surge tank in accordance with the technology disclosed herein can be made of metal or other durable materials, desirably the surge tank is formed, such as by molding, from a plastic or polymer material with polypropylene plastic being one specific example (Hostacom 1850 polypropylene is a more specific example). Among the desirable functions of a surge tank in accordance with the selected embodiments of surge tanks incorporating some or portions of the technology disclosed herein are the following: The provision of coolant system pressure regulation achieved by restricting the flow rate through initial chambers of or leading to a surge tank; the provision of an easily fillable coolant system that is easy to inspect, as well as a surge tank that can readily be drained of coolant, if required; the provision of a positive pressure to a coolant or water pump, in applications where such a positive pressure is desired; the provision of a system which allows for coolant expansion; and the provision of a surge tank with enhanced de-aeration properties. Also, a surge tank in accordance with aspects of the disclosed technology permits a reduction in surge tank size, is insensitive to variations in the flow volume of delivered coolant which depends upon engine types, eliminates the need for a vent hose subassembly, and simplifies the routing of vent lines.

It should be understood that the technology disclosed herein encompasses designs which achieve one or more of the above benefits and is not limited to designs that achieve all of these benefits.

In this disclosure, these terms "a", "an" and "at least one" encompass both the singular and the plural. Thus, for example, the reference to "an element" is met by an apparatus that includes one of such elements as well as by an apparatus which includes a plurality of such elements because in the example where there is a plurality of such elements, there is also an element. Also, the terms "couple" and "coupled" encompass both direct connection and indirect connection through one or more other elements.

Figure 5:
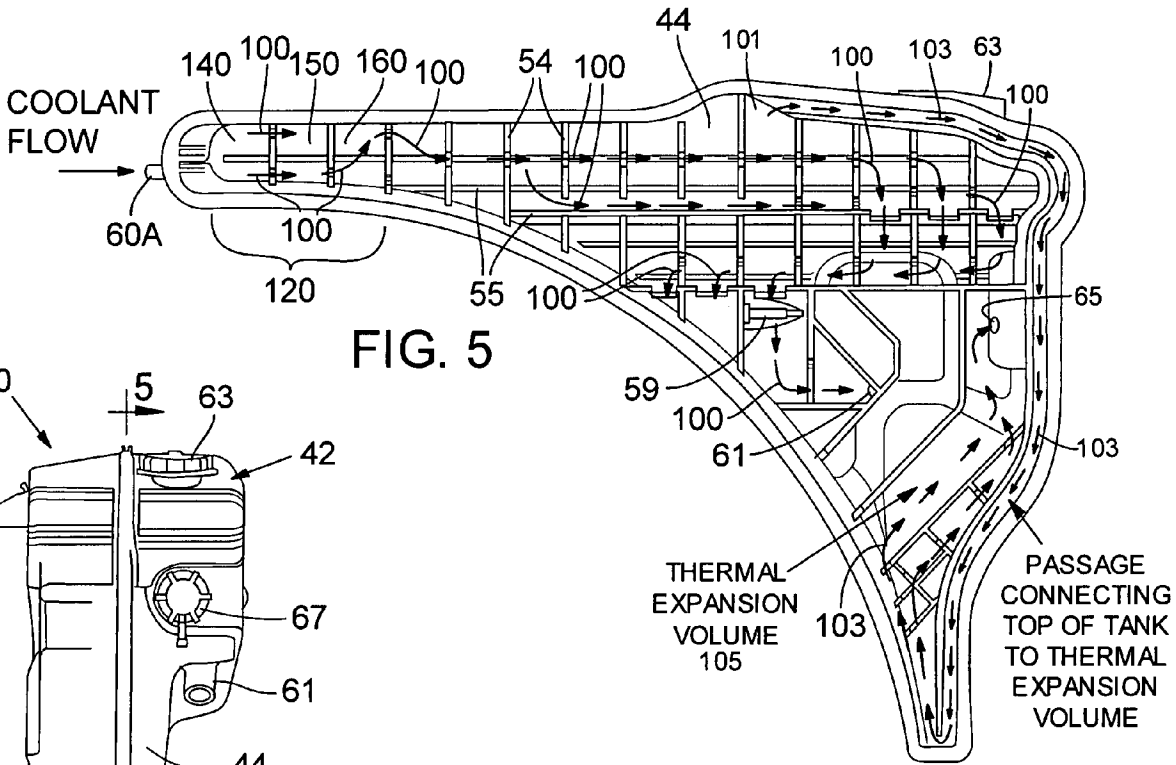
FIG. 5 is a vertical sectional view of the surge tank of FIG. 4 taken along line 5-5 of FIG. 4.
Figure 4:
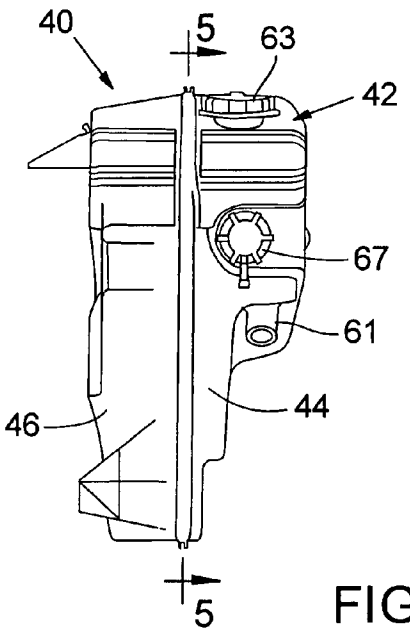
FIG. 4 is an elevational view of the surge tank of FIG. 2.

With reference to FIGS. 2-5, one embodiment of an exemplary form of surge tank apparatus 40 is illustrated. The apparatus 40 comprises a housing 42 having a generally hollow interior 44 (see FIG. 5). The housing may be formed of housing sections, such as sections 45 and 46, that are secured together such as by fasteners, adhesive or otherwise. The interior of the housing 42 is reinforced by various reinforcements such as by a plurality of upright ribs (some of which are given the number 54 in FIG. 2) and cross-supports or shelves, several of which are numbered as 55 in FIG. 5. The ribs 54 in FIG. 5 are generally upright and may be parallel to one another and vertical when the surge tank is installed in a vehicle. In addition, the shelves 55 extend transversely within the tank housing and may be horizontal when the tank is installed. These orientations are not required. Other reinforcements may be included such as shown in FIG. 5 or otherwise. In FIG. 5, the covering housing section 46 has been removed to facilitate the explanation.

The embodiment of FIGS. 2-5 includes a low level sensor 59 for detecting the level of coolant in the surge tank housing. If the level drops below the level of the sensor, a signal is sent which can then be used, for example, to shut down the engine until such time as coolant is replenished. Alternatively, the signal may be used to generate a warning message. The surge tank 40 may be included in the FIG. 1 system, for example, in place of the surge tank 26 shown in FIG. 1. The illustrated surge tank further comprises a coolant outlet 61 out of which coolant traveling through the surge tank is delivered to the engine. That is, outlet 61 comprises a coolant reservoir outlet coupled to the engine, such as via an engine pump. Coolant may be added to the system through a coolant full inlet covered by a cap 63 in this embodiment. Also, air de-aerated from coolant passing through the surge tank 40 may exit through a pressure relief outlet 65 (FIG. 5) closed by a conventional pressure cap 67 which operates to allow fluid to pass therethrough in the event pressure is sufficient to allow venting through the cap.

Figure 2:
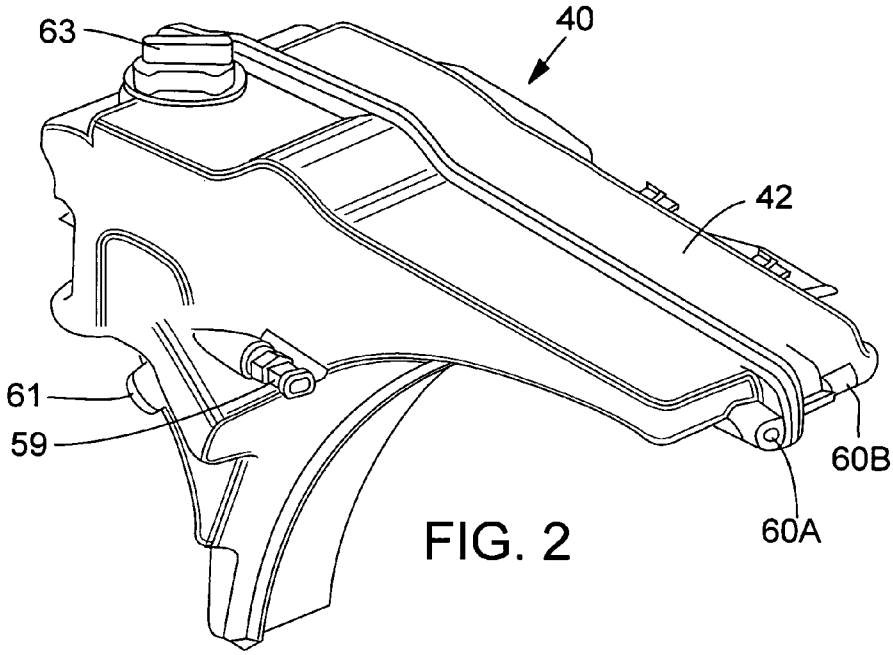
FIG. 2 is a perspective view of one embodiment of a surge tank in accordance with this disclosure.
Figure 3:
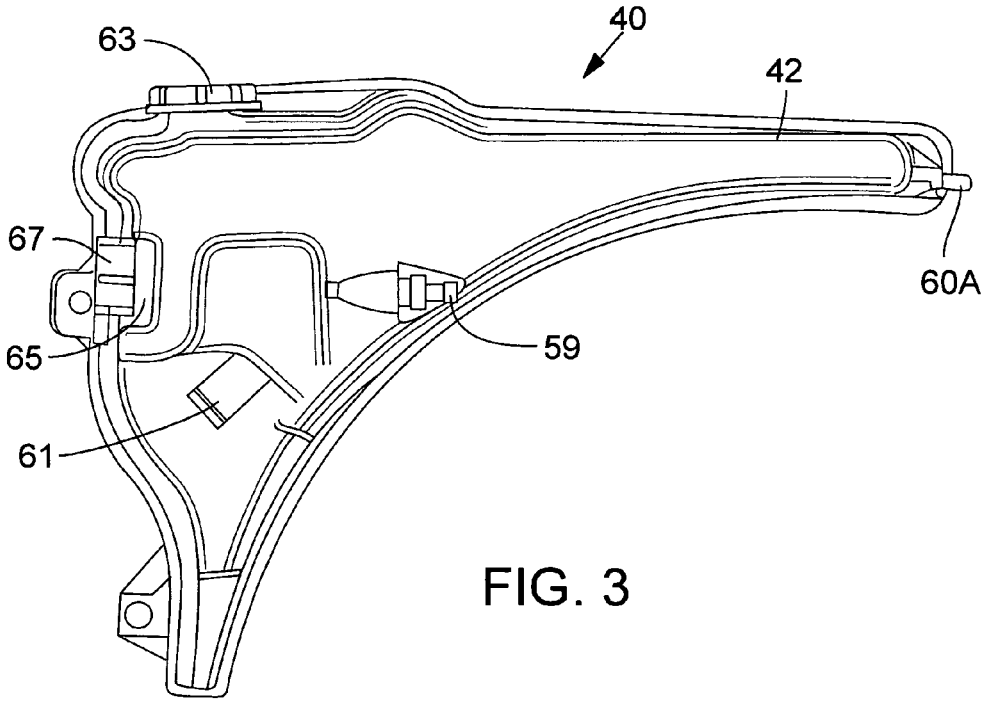
FIG. 3 is a side elevational view of the surge tank of FIG. 2.

At least one coolant flow inlet is provided for delivery of coolant to the surge tank. In the embodiment shown in FIGS. 2-5, an inlet 60A receives coolant from the vent of an engine (e.g., via line 24 in FIG. 1). In addition, an inlet 60B receives coolant from a radiator vent inlet (e.g., via a conduit 28 in FIG. 1). As shown in FIG. 2, the inlet 60A has a longitudinal axis that is oriented at an angle with respect to the long axis of an upper portion of the surge tank. In addition, inlet 60B has an access which is oriented at 90 degrees with respect to the longitudinal access of the upper end of the surge tank. These orientations can be changed in a manner that facilitates connection to various lines depending upon engine and radiator placement in the vehicle and the placement of the surge tank therein.

With reference to FIG. 5, coolant entering the surge tank passes through a series of chambers of a pre-tank section 120 prior to reaching a main coolant receiving reservoir portion of the surge tank. In the embodiment of FIG. 5, there are three such pre-chambers 140, 150 and 160, the operation of which will be described below. The technology is not limited to a three chamber pre-tank construction. For example, more than one intermediate chamber 150 can be used. In addition, although less desirable, the intermediate chambers can be eliminated with a system including an initial chamber 140 and an exit chamber 160 which are both flooded (filled with coolant) during normal steady state operation of the surge tank with coolant being delivered to the surge tank from the engine (and also from a radiator if the radiator is connected thereto). The steady state operation refers to an operation following initial filling of the chambers. In general, flow out of the first chamber 140 is restricted such that the first chamber fills and coolant is then introduced into a pool of coolant within the first chamber to assist in absorbing energy from the fluid. Liquid flow within the first chamber is generally turbulent. In addition, the primary flow of fluid from the exiting chamber is through one or more openings at the upper portion of the exiting chamber so that the distance between the exiting liquid and the upper portion of the surge tank is reduced. As a result, bubbles need not travel a significant distant upwardly to separate from the liquid. A lower drain opening can be provided in the exiting chamber to assist in draining coolant in the event the surge tank is drained. Also, vent openings may be provided at upper portions of the first and any intermediate chambers, and in communication with the exiting chamber, to provide a pathway for air to vent during initial filling of the surge tank.

In FIG. 5, a plurality of arrows, some of which are numbered as 100, illustrate the general flow path of coolant from the coolant inlet 60A (and also from coolant inlet 60B) through the chambers 140, 150 and 160 and through the coolant reservoir to the outlet 61. Some of these arrows have been given the number 100 for reference purposes. Also, in the embodiment of FIG. 5, an air entrapment area 101 is provided at an uppermost portion of the reservoir of the surge tank. De-aerated air tends to travel to this entrapment area from which it can pass along a generally downwardly directed passageway (indicated by arrows some of which have been numbered as 103) to the pressure cap outlet 65 through which air can be vented from the surge tank. Internal ribs within the surge tank, when the housing sections are assembled, separate the coolant flow pathway from the air flow pathway (except via the connection from entrapment area 101 to the air flow pathway). This separated area provides a thermal expansion volume into which coolant may flow in the event it expands due to heating of the coolant.

Figure 6:
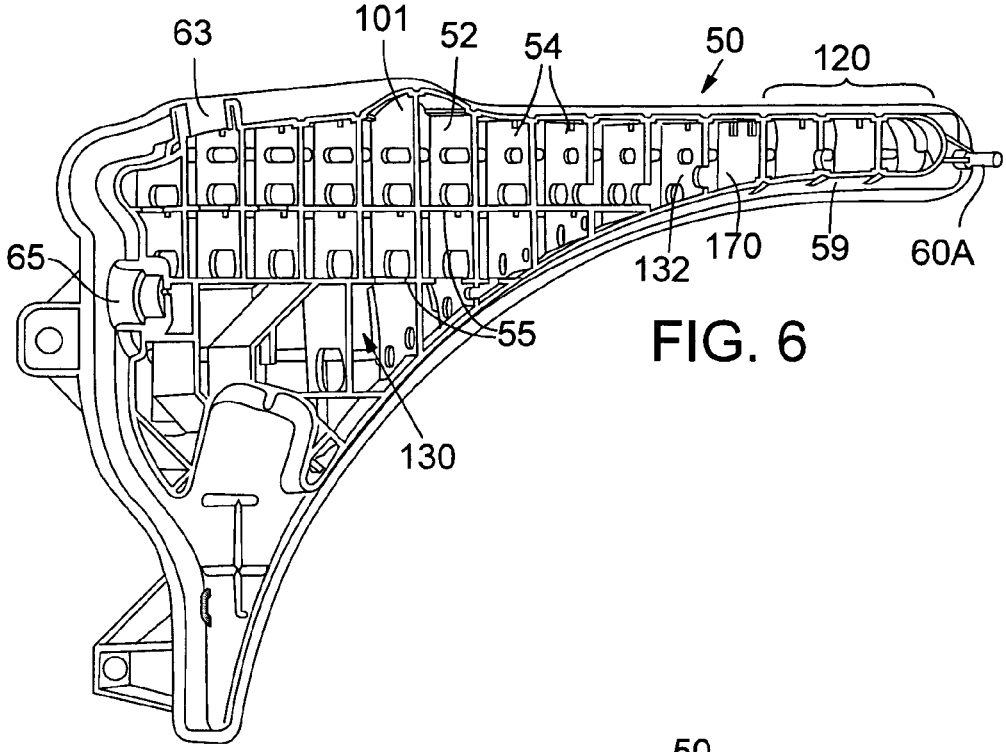
FIG. 6 is a partially broken-away vertical sectional view of one embodiment of a surge tank illustrating various fluid passageways through interior reinforcements found in the surge tank of this embodiment.
Figure 7:
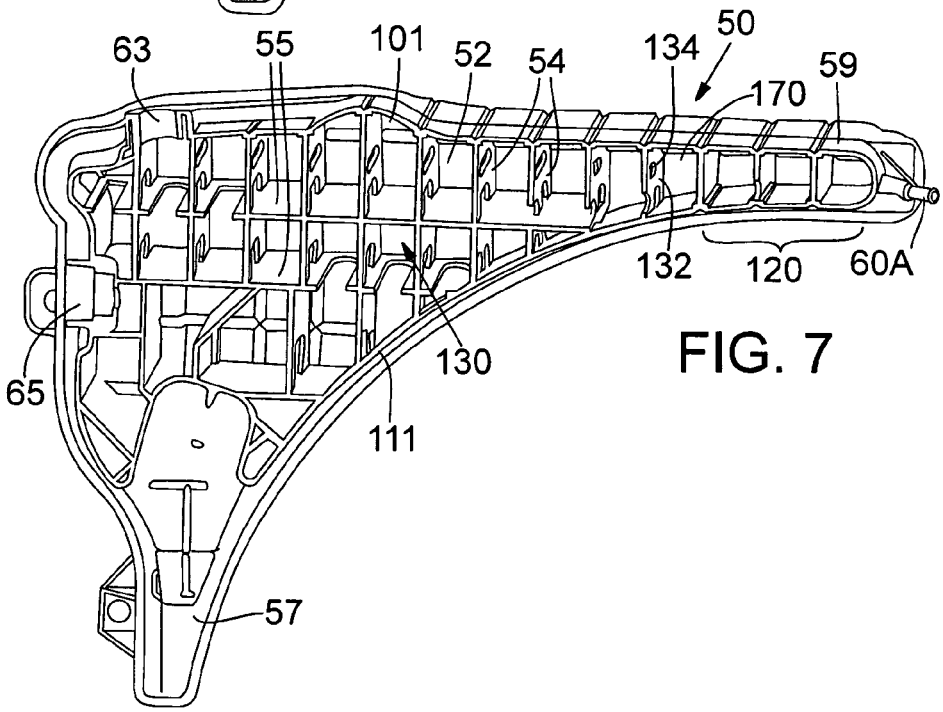
FIG. 7 is a perspective view of the embodiment of FIG. 6 looking downwardly somewhat in comparison to the view shown in FIG. 6.

With reference to FIGS. 6 and 7, the surge tank of these figures also comprises a body 50 having a generally hollow interior 52 separated and reinforced by a plurality of upright ribs (some of which are given the number 54 in FIGS. 6 and 7) and cross-supports or shelves, several of which are numbered as 55 in these figures. The ribs 54 in FIG. 2 are generally upright and may be parallel to one another and vertical when the surge tank is installed in a vehicle. In addition, the shelves 55 extend transversely within the tank and may be horizontal when the tank is installed. Other reinforcements may be included such as shown in these figures. A portion of the covering side section of the tank 50 has been removed in FIGS. 6 and 7 for purposes of explanation. The covering side section portion that overlies the tank portions of FIGS. 6 and 7 would have additional portions of the shelves and ribs in this example because of where the vertical section has been taken through the portion of the surge tank shown in these two figures.

The illustrated surge tank is somewhat triangular-like in vertical section with an upwardly arching lower wall portion 111. The illustrated surge tank has a lower neck portion 57 and an elongated snout portion 59.

The illustrated surge tank portion of FIGS. 6 and 7 comprises at least one inlet 60A. In one specific example, the inlet has a ⅜ inch outside diameter and a 4.5 mm inside diameter. More than one inlet can be provided, such as one to receive coolant from a radiator and one to receive coolant from an engine. Alternatively, passageways or conduits from the radiator and engine may be joined together before reaching a single inlet. The body 50 also defines an air venting outlet 65, through which de-aerated air may pass. Opening 65 is desirably covered with a pressure cap as previously explained to permit the passage of air while preventing dirt and the like from entering the coolant. At least one coolant exit is also provided through which de-aerated coolant may be delivered back to the engine directly or through other components of the cooling system. The baffles or ribs and shelves shown in the embodiment of FIGS. 6 and 7 are provided with openings at selected locations through which coolant flows as it traverses through the surge tank.

The illustrated surge tank comprises a series of chambers adjacent to the inlet 60A into which coolant is delivered to the surge tank. These receiving chambers are collectively indicated by the number 120 in FIGS. 6 and 7 and comprise a pre-tank portion that is desirably included in the overall surge tank housing construction. Less desirably, the pre-tank chambers may be in one or more separate structures. The various chambers and surge tank baffles and shelves to the left of the chambers 120 in FIGS. 6 and 7 in this embodiment comprise the main or primary coolant reservoir of the surge tank within which coolant passes and pools as the coolant flows through the surge tank. This primary reservoir area is indicated by the number 130 in FIGS. 6 and 7. From area 130, air bubbles drift upwardly and to area 101 and are eventually vented (e.g., via opening 65 or upwardly from an opening from area 101 in the event a large air gap volume is provided at this location). The uppermost openings in the upright ribs to the left of the chambers represented by number 120 (e.g., from rib 132 leftwardly with the uppermost opening in rib 132 being given the number 134) are typically submerged. Vent openings may be positioned above the normal fluid level in the surge tank to provide air flow passageways for air to travel toward collection area 101 as air bubbles upwardly from the coolant.

Figure 8:
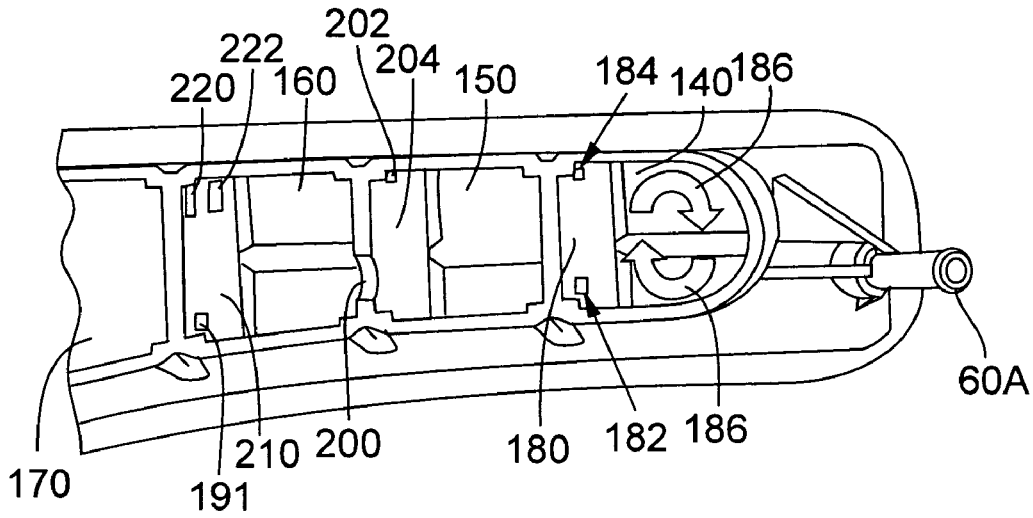
FIG. 8 is a pictorial illustration of initial chambers of a surge tank in accordance with the embodiment of FIG. 6.
Figure 9:
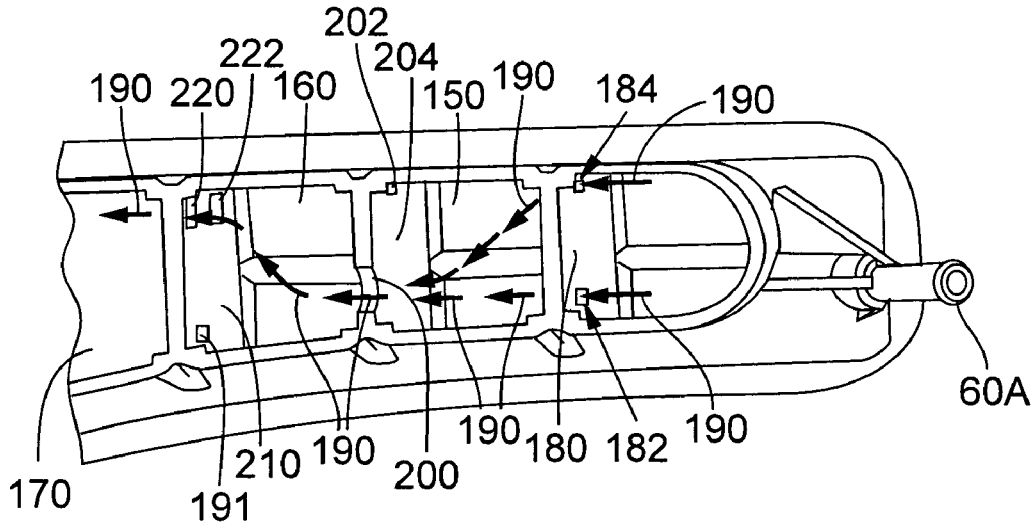
FIG. 9 is similar to FIG. 8 with arrows indicating a flow path of air bubble containing coolant liquid as it passes through the illustrated chambers of this exemplary embodiment.
Figure 10:
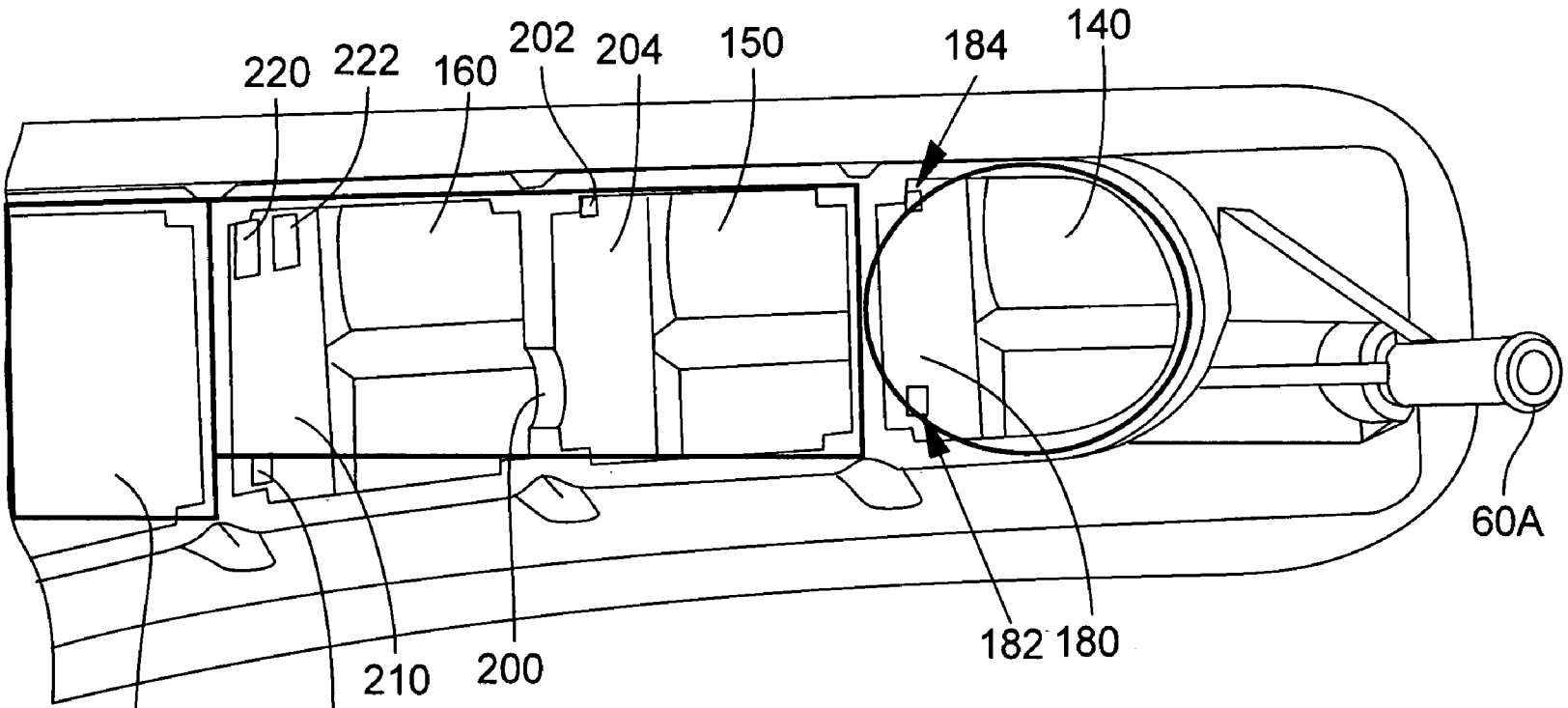
FIG. 10 is a slightly enlarged view of the embodiment of FIG. 8 with exemplary geometries of the first three chambers of this embodiment highlighted with outlines for illustrative purposes.

With reference to FIGS. 8-10, an exemplary turbulence reducing section 120 of the illustrated embodiment of a surge tank 50 is shown. In the illustrated embodiment, a plurality of chambers are situated in series through which coolant passes in a manner that reduces the energy of the passing fluid and minimizes or eliminates the foaming or air bubble fracturing in the coolant tank. In the illustrated embodiment, there are three such chambers 140, 150 and 160 prior to reaching a chamber 170, which is part of the primary coolant reservoir portion of the surge tank (130 in FIG. 6).

Chamber 140 desirably comprises a flow restriction chamber. Coolant entering the chamber 140 through inlet 60A is flowing at a relatively high flow rate, such as three to four gallons per minute. This entering fluid is aerated and has a high kinetic energy. Assuming the surge tank is empty, as it is initially being filled, aerated coolant entering inlet 60 flows into chamber 140. The forward flow of the liquid is interrupted by a rib or wall 180 that separates chamber 140 from chamber 150. A restriction device, such as one or more relatively small orifice outlets, restricts the passage of liquid from chamber 140 such that chamber 140 fills. As a specific example, the restriction device may comprise upper and lower passageways or orifices 182, 184. The dimensions of these orifices may vary. However, a specific example are passageways 182, 184 that are each 5 mm by 10 mm (50 mm square), respectively located adjacent to the upper and lower portions of the wall 180. These passageways are typically spaced slightly away from the adjacent upper and lower walls of the chamber to minimize the possibility of concentrated stresses at these locations. The passages may be of any suitable shape. For example, they may be round instead of rectangular. At steady state, coolant flows out of chamber 140 through the passageways 182, 184 at the same rate that fluid enters the inlet 60. The fluid in chamber 140 exhibits a turbulent flow as indicated by arrows 186 in FIG. 8. Following the flooding of chamber 140 with coolant, coolant entering the surge tank from inlet 60A flows into the coolant within the chamber 140 instead of into a gap above the coolant. Desirably, the location of inlet 60A is below the midline of chamber 140. The flooding or filling of chamber 140 regulates the flow of coolant into the surge tank and assists in diffusing fluid energy from the entering coolant.

As can be seen in FIG. 9, bubble containing fluid passes through the upper passageway 184 and the lower passageway 182 following a bubble path indicated by arrows 190 in FIG. 9. As can be seen in FIG. 10, the entrance wall portion of chamber 140 desirably has a circular portion, although this is not required.

Desirably, the second chamber 150 is also flooded by the coolant during steady state operation of the system. The majority and more desirably substantially all of the volume of the coolant passes from chamber 150 to chamber 160 through one or more lower openings, such as through a single lower opening 200. The cross-sectional area of opening 200 is desirably greater than the total of the cross-sectional areas through openings 182 and 184, such that the velocity of coolant flowing between chambers 150 and 160 through opening 200 is reduced in comparison to the velocity of coolant flowing from chamber 140 to chamber 150. Thus, chamber 150 can be viewed as one form of a fluid energy dispersement chamber. Although variable in both cross-sectional area and shape, one specific example of passageway 200 is a circular passageway having a diameter of 20 mm (and thus a cross-sectional area of about 314 sq. mm). Passageway 200 in this example is formed in a lower portion of a rib or wall 204 that separates the chamber 150 and the chamber 160. A small upper vent opening 202 is also provided through rib 204. Opening 202 may be similar in size to the openings 182 and 184. Opening 202 provides a pathway for air that may de-aerate in chamber 150 to flow to the chamber 160. Opening 202 also provides a pathway for air to flow from chamber 150 to chamber 160 during initial filling of the surge tank.

Chamber 160 is also desirably flooded (filled) during steady state operation (following initial filling) of the surge tank. Chamber 160 is separated from the remaining portions of the surge tank in this example by a rib or wall 210. Chamber 160 is one form of an air-liquid separation chamber or a laminar flow enhancement chamber. At least one opening, in this case two openings 220, 222 are provided in upper region of rib 210 through which coolant can flow from chamber 160 to chamber 170. Liquid exiting chamber 160 is substantially in a laminar flow condition. Because openings 220 and 222 are adjacent to an upper region of rib 210, coolant flowing through chamber 160 passes generally in a skewed direction (e.g., most fluid flow is somewhat diagonal from passageway 200 to passageways 220 and 222 through chamber 160) through the chamber. That is, the fluid is forced to change direction and flow upwardly as it passes from chamber 150 and through chamber 160. This is indicated in FIG. 9 by arrows 190 in chamber 160. Thus, there is desirably no direct substantially aligned flow path through lower regions of the ribs 180, 204 and 210 in the illustrated embodiment through which fluid containing entrained air may flow directly in a straight line from the inlet 60A to an outlet of the surge tank. Also, the openings 220 and 222 are desirably adjacent to the upper wall of the surge tank. For this reason, as fluid enters chamber 170, very little distance is required for air bubbles to travel upwardly to separate from the liquid coolant.

Although passageways 220 and 222 may be combined and other shapes may be used, desirably the cross-sectional area of passageways exiting chamber 160 is greater than the cross-sectional area of passageway 200 so that again the velocity of the liquid slows as it passes into chamber 170. For example, each of the two passageways 220, 222 may be rectangular having respective sides that are 10 mm and 20 mm such that the total cross-sectional area through passageways 220 and 222 is 400 square mm. Thus, the majority of coolant, and desirably substantially all of the coolant, exiting from chamber 160 passes through one or more upper openings.

A small drain opening 191 (for example sized like one of the openings 182) is desirably positioned at a lower portion of chamber 160 to assist in draining the chambers 140, 150 and 160 in the event the surge tank is to be drained. Also, another drain is desirably provided at the lowermost portion of the surge tank main reservoir.

In the illustrated construction, the initial chambers themselves are of a progressively greater volume although this is not required. An exemplary first chamber has approximate dimensions of 50 mm by 60 mm by 100 mm deep, although again this can be varied.

Thus, the chambers 150 and 160 further dissipate kinetic energy in the liquid while directing air bubbles toward the top of the surge tank. The fluid air bubble mixture exiting chamber 160 thus exits the pre-tank or initial chambers with minimal kinetic energy and minimal rise distance for entrapped air. The smooth or laminar transition into the main or primary fluid containing area of the tank body, in combination with the minimal rise distance for air in the liquid to travel to separate from the liquid as it leaves chamber 160, assists in optimizing air and fluid separation.

Thus, the desirable combination of delivering liquid into an existing pool of coolant in a first chamber of a pre-tank, together with progressively increasing the total cross-sectional area of outlet passageways between successive chambers of a pre-tank, as well as causing a majority of, and more desirably substantially all of, the coolant to exit from the last chamber of a pre-tank near an upper region of the surge tank, all contribute to effective bubble removal from the coolant.

The pre-tank, in the illustrated example comprising three chambers formed as part of the surge tank, assists in reducing the kinetic energy and turbulence of incoming liquid, minimizes aeration arising from the flow of liquid through the tank, and establishes a flow rate into the tank (for example, by the inlet size). The pre-tank section 120 initiates the air-water separation and provides connections for input liquid flow into the surge tank. Also, various openings assist in optimizing the initial flow rate of the system as air initially trapped in the pre-tank chambers can pass from chamber to chamber and to an air exit from the surge tank as the surge tank is filled. Embodiments in accordance with this disclosure provide improved air separation from liquid in a vehicle surge tank application while permitting surge tanks of smaller size to be used. In addition, performance insensitivity between varying cooling packages and engine designs results as the surge tank may be used with varying types of engines and cooling systems. In addition, some assemblies and restrictors, although they could be used, desirably are not required in this construction. Also, common inlet sizes, e.g., ⅜ inch hoses, can be used for installations in various truck applications.

Moreover, surge tanks in accordance with the disclosed technology provide a calm laminar coolant entry into the main coolant reservoir portion of the surge tank, minimizes the distance that bubbles must rise to separate from liquid flowing through the surge tank, minimizes viscous forces in the surge tank by absorbing such forces in initial chambers, such as pre-tank chambers provided in the surge tank, provides an air separation space above liquid in the surge tank, and eliminates the need for aerating features in the primary coolant reservoir portion of the surge tank itself.

The technology is not limited to embodiments that achieve all of the advantages set forth herein. Instead, the technology is directed to any one or more of the novel and non-obvious features of surge tanks as well as methods associated therewith.

Having illustrated and described the principles of our technology with respect to several exemplary embodiments, it should be apparent that these embodiments may be varied in arrangement and detail without departing from the inventive principles disclosed herein. For example, the dimensions of the various chambers and number of chambers of the pre-tank or entry section of the surge tank can be varied.

We claim:

1. A surge tank apparatus for receiving a flow comprising coolant from at least an engine of a vehicle, the apparatus comprising:

at least two chambers and a coolant reservoir, one of said at least two chambers comprising a coolant receiving inlet for coupling to the engine to receive coolant from the engine and at least one coolant outlet from which coolant passing through said one of said at least two chambers is delivered, another of said at least two chambers comprising at least one other coolant receiving inlet for coupling to said at least one coolant outlet for receiving coolant from said at least one coolant outlet when the coolant receiving inlet is receiving coolant from the engine, said another of said at least two chambers comprising at least one other coolant outlet from which coolant passing through said another chamber is delivered, and the coolant reservoir comprising a coolant reservoir inlet coupled to said at least one other coolant outlet and a reservoir outlet through which coolant is returned to the engine;

said at least one other coolant outlet being positioned adjacent to a top portion of the coolant reservoir;

said at least one coolant outlet and said at least one other coolant outlet being sized to restrict the flow of coolant through said another of said at least two chambers so as to cause said one of said at least two chambers and said another of said at least two chambers to fill with coolant when coolant is delivered to said coolant inlet from the engine; and the total cross sectional area of all outlets comprising said at least one other coolant outlet being greater than the total cross sectional area of all outlets comprising said at least one coolant outlet such that the velocity of coolant flow through said at least one other coolant outlet is lower than the velocity of coolant flow through said at least one coolant outlet.

2. An apparatus according to claim 1 wherein there is at least one intermediate chamber through which coolant passes from said one of said at least two chambers to said another of said at least two chambers; the at least one intermediate chamber being coupled to said at least one other coolant inlet and said at least one other coolant outlet being positioned and sized such that at least a majority of coolant that enters said at least one other coolant inlet flows upwardly through said another of said at least two chambers to the at least one other coolant outlet.

3. An apparatus according to claim 2 wherein said at least one other coolant inlet is located at a lower portion of said another of said at least two chambers.

4. An apparatus according to claim 3 further comprising at least one drain opening at a lower portion of said another of said at least two chambers in communication with the coolant reservoir and at least one vent opening at an upper portion of said another of said at least two chambers coupled to said one of said at least two chambers through said at least one intermediate chamber.

5. An apparatus according to claim 1 comprising a common housing defining the at least two chambers and coolant reservoir therein.

6. An apparatus according to claim 5 wherein the housing is comprised of plastic.

7. An apparatus according to claim 1 further comprising at least one drain opening at a lower portion of said another of said at least two chambers in communication with the coolant reservoir and at least one vent opening at an upper portion of said another of said at least two chambers coupled to said one of said at least two chambers.

8. An apparatus according to claim 1 incorporated into a land vehicle in combination with an engine and a radiator, the engine and the radiator each being coupled to at least one coolant receiving inlet.

9. A surge tank apparatus for receiving a flow comprising coolant from a radiator and from an engine of a vehicle, the apparatus comprising:

first, second, and third chambers coupled together so as to permit the flow of coolant through said first, second and third chambers and into the coolant reservoir;

the first chamber comprising at least one first chamber coolant inlet coupled to the radiator and the engine for receiving coolant from the radiator and from the engine, the first chamber comprising at least one first chamber outlet from which coolant is delivered from the first chamber;

the second chamber comprising at least one second chamber inlet coupled to the at least one first chamber outlet for receiving coolant passing through the first chamber, the second chamber comprising at least one second chamber outlet from which coolant is delivered from the second chamber;

the third chamber comprising at least one third chamber inlet coupled to the at least one second chamber outlet for receiving coolant passing through the second chamber, the third chamber comprising at least one third chamber outlet from which coolant is delivered from the third chamber;

the coolant reservoir comprising at least one reservoir receiving inlet coupled to the at least one third chamber outlet for receiving coolant passing through the third chamber, the coolant reservoir comprising at least one reservoir outlet for coupling to the engine through which coolant is returned to the engine from the coolant reservoir;

wherein the at least one first chamber outlet has a cross-sectional area sized to restrict the flow of coolant through the first chamber such that when the at least one first chamber inlet is coupled to an engine and a radiator, the first chamber and at least one first chamber inlet is filled with coolant so that coolant flows into the first chamber through the at least one first chamber coolant inlet into a pool of coolant in the first chamber; and wherein the coolant reservoir has a top portion and wherein the at least one third chamber outlet is at an upper region of the third chamber and is adjacent to the top portion of the coolant reservoir; and wherein the second chamber comprises a greater volume than the first chamber and the third chamber comprises a greater volume than the second chamber.

10. An apparatus according to claim 9 wherein the first chamber comprises upper and lower first chamber portions, the apparatus comprising a first wall separating the first chamber from the second chamber, the at least one first outlet comprising at least one upper passageway and at least one lower passageway positioned respectively adjacent to the respective upper and lower first chamber portions.

11. An apparatus according to claim 9 wherein the at least one first, at least one second and at least one third outlets are configured and positioned to provide substantially laminar flow of coolant from the at least one third outlet to the coolant reservoir.

12. An apparatus according to claim 9 comprising a common single tank housing having the first, second and third chambers and the coolant reservoir positioned therein.

13. A surge tank apparatus for receiving a flow comprising coolant from a radiator and from an engine of a vehicle, the apparatus comprising:

first, second, and third chambers coupled together so as to permit the flow of coolant through said first, second and third chambers and into the coolant reservoir;

the first chamber comprising at least one first chamber coolant inlet coupled to the radiator and the engine for receiving coolant from the radiator and from the engine, the first chamber comprising at least one first chamber outlet from which coolant is delivered from the first chamber;

the second chamber comprising at least one second chamber inlet coupled to the at least one first chamber outlet for receiving coolant passing through the first chamber, the second chamber comprising at least one second chamber outlet from which coolant is delivered from the second chamber;

chamber comprising at least one third chamber outlet from which coolant is delivered from the third chamber;

the coolant reservoir comprising at least one reservoir receiving inlet coupled to the at least one third chamber outlet for receiving coolant passing through the third chamber, the coolant reservoir comprising at least one reservoir outlet for coupling to the engine through which coolant is returned to the engine from the coolant reservoir;

wherein the at least one first chamber outlet has a cross-sectional area sized to restrict the flow of coolant through the first chamber such that when the at least one first chamber inlet is coupled to an engine and a radiator, the first chamber and at least one first chamber inlet is filled with coolant so that coolant flows into the first chamber through the at least one first chamber coolant inlet into a pool of coolant in the first chamber;

wherein the coolant reservoir has a top portion and wherein the at least one third chamber outlet is at an upper region of the third chamber and is adjacent to the top portion of the coolant reservoir; and wherein the second chamber comprises upper and lower second chamber portions and the third chamber comprises upper and lower third chamber portions, the apparatus comprising a second wall separating the second chamber from the third chamber and a third wall separating the third chamber from the coolant reservoir, the at least one second chamber outlet comprising at least one second lower passageway through the second wall and located in the lower second chamber portion, the total cross sectional area of all of the second lower passageways that comprise said at least one second lower passageway of said at least one second chamber outlet being sized for passage therethrough of at least a majority of coolant that reaches the second chamber from the first chamber when the at least one first chamber is coupled to an engine and a radiator, the at least one third chamber outlet comprising at least one third upper passageway through the third wall and located in the upper third chamber portion, the total cross sectional area of all the third upper passageways that comprise said at least one third upper passageway of said at least one third chamber outlet being sized for passage therethrough of at least a majority of the coolant that reaches the third chamber from the second chamber, the total cross sectional area of the second lower passageways and the total cross sectional area of the third upper passageways being sized such that a majority of the coolant passing from the second chamber to the third chamber flows through the second lower passageways into the third chamber and a majority of the coolant flowing from the third chamber flows through the third upper passageways.

14. An apparatus according to claim 13 wherein the at least one third upper passageway comprises plural upper passageways.

15. An apparatus according to claim 14 further comprising at least one lower drain passageway through the third wall and located in the lower third chamber portion.

16. An apparatus according to claim 15 further comprising at least one upper vent passageway through the second wall and located in the upper second chamber portion.

17. An apparatus according to claim 13 wherein the majority of coolant that reaches the second chamber from the first chamber and that reaches the third chamber from the second chamber consists of substantially all of the coolant.

18. An apparatus according to claim 12 wherein the total cross-sectional area of the second lower passageways and the total cross-sectional area of the third upper passageways are sized such that substantially all of the coolant enters the third chamber through the second lower passageways and flows from the third chamber through the third upper passageways.

19. A surge tank apparatus for receiving a flow comprising coolant from at least an engine of a vehicle, the apparatus comprising:

at least two chambers and a coolant reservoir, one of said at least two chambers comprising a coolant receiving inlet for coupling to the engine to receive coolant from the engine and at least one coolant outlet from which coolant passing through said one of said at least two least one other coolant receiving inlet for coupling to said at least one coolant outlet for receiving coolant from said at least one coolant outlet when the coolant receiving inletis receiving coolant from the engine, said another of said at least two chambers comprising at least one other coolant outlet from which coolant passing through said another chamber is delivered, and the coolant reservoir comprising a coolant reservoir inlet coupled to said at least one other coolant outlet and a reservoir outlet through which coolant is returned to the engine;

said at least one other coolant outlet being positioned adjacent to a top portion of the coolant reservoir;

said at least one coolant outlet and said at least one other coolant outlet being sized to restrict the flow of coolant through said another of said at least two chambers so as to cause said one of said at least two chambers and said another of said at least two chambers to fill with coolant when coolant is delivered to said coolant inlet from the engine; and wherein the total cross-sectional area of all outlets from said another of said at least two chambers is greater than the total cross-sectional area of all outlets from said one of said at least two chambers.

20. A surge tank apparatus for receiving a flow comprising coolant from a radiator and from an engine of a vehicle, the apparatus comprising:

first, second, and third chambers coupled together so as to permit the flow of coolant through said first, second and third chambers and into the coolant reservoir;

the first chamber comprising at least one first chamber coolant inlet coupled to the radiator and the engine for receiving coolant from the radiator and from the engine, the first chamber comprising at least one first chamber outlet from which coolant is delivered from the first chamber;

the second chamber comprising at least one second chamber inlet coupled to the at least one first chamber outlet for receiving coolant passing through the first chamber, the second chamber comprising at least one second chamber outlet from which coolant is delivered from the second chamber;

the third chamber comprising at least one third chamber inlet coupled to the at least one second chamber outlet for receiving coolant passing through the second chamber, the third chamber comprising at least one third chamber outlet from which coolant is delivered from the third chamber;

the coolant reservoir comprising at least one reservoir receiving inlet coupled to the at least one third chamber outlet for receiving coolant passing through the third chamber, the coolant reservoir comprising at least one reservoir outlet for coupling to the engine through which coolant is returned to the engine from the coolant reservoir;

wherein the at least one first chamber outlet has a cross-sectional area sized to restrict the flow of coolant through the first chamber such that when the at least one first chamber inlet is coupled to an engine and a radiator, the first chamber and at least one first chamber inlet is filled with coolant so that coolant flows into the first chamber through the at least one first chamber coolant inlet into a pool of coolant in the first chamber;

wherein the coolant reservoir has a top portion and wherein the at least one third chamber outlet is at an upper region of the third chamber and is adjacent to the top portion of the coolant reservoir;

wherein the first chamber comprises upper and lower first chamber portions, the apparatus comprising a first wall separating the first chamber from the second chamber, the at least one first outlet comprising at least one upper passageway and at least one lower passageway positioned respectively adjacent to the respective upper and lower first chamber portions;

wherein the second chamber comprises upper and lower second chamber portions and the third chamber comprises upper and lower third chamber portions, the apparatus comprising a second wall separating the second chamber from the third chamber and a third wall separating the third chamber from the coolant reservoir, the at least one second chamber outlet comprising at least one second lower passageway through the second wall and located in the lower second chamber portion, the total cross sectional area of all the second lower passageways that comprise said at least one second lower passageway of said at least one second chamber outlet being sized for passage therethrough of at least a majority of coolant that reaches the second chamber from the first chamber when the at least one first chamber is coupled to an engine and a radiator, the at least one third chamber outlet comprising at least one third upper passageway through the third wall and located in the upper third chamber portion, the total cross sectional area of all of the third upper passageways that comprise said at least one third upper passageway of said at least one third chamber outlet being sized for passage therethrough of at least a majority of the coolant that reaches the third chamber from the second chamber; and wherein the total cross-sectional area of all second outlets is greater than the total cross-sectional area of all of the first outlets, and wherein the total cross-sectional area of all of the third outlets is greater than the total cross-sectional area of all of the second outlets.

21. A surge tank apparatus for receiving a flow comprising coolant from a radiator and from an engine of a vehicle, the apparatus comprising:

first, second, and third chambers coupled together so as to permit the flow of coolant through said first, second and third chambers and into the coolant reservoir;

the first chamber comprising at least one first chamber coolant inlet coupled to the radiator and the engine for receiving coolant from the radiator and from the engine, the first chamber comprising at least one first chamber outlet from which coolant is delivered from the first chamber;

the second chamber comprising at least one second chamber inlet coupled to the at least one first chamber outlet for receiving coolant passing through the first chamber, the second chamber comprising at least one second chamber outlet from which coolant is delivered from the second chamber;

the third chamber comprising at least one third chamber inlet coupled to the at least one second chamber outlet for receiving coolant passing through the second chamber, the third chamber comprising at least one third chamber outlet from which coolant is delivered from the third chamber;

the coolant reservoir comprising at least one reservoir receiving inlet coupled to the at least one third chamber outlet for receiving coolant passing through the third chamber, the coolant reservoir comprising at least one reservoir outlet for coupling to the engine through which coolant is returned to the engine from the coolant reservoir;

wherein the at least one first chamber outlet has a cross-sectional area sized to restrict the flow of coolant through the first chamber such that when the at least one first chamber inlet is coupled to an engine and a radiator, the first chamber and at least one first chamber inlet is filled with coolant so that coolant flows into the first chamber through the at least one first chamber coolant inlet into a pool of coolant in the first chamber; and wherein the coolant reservoir has a top portion and wherein the at least one third chamber outlet is at an upper region of the third chamber and is adjacent to the top portion of the coolant reservoir; and wherein the total cross-sectional area of all of the second outlets is greater than the total cross-sectional area of all of the first outlets and wherein the total cross-sectional area of all of the third outlets is greater than the total cross-sectional area of all of the second outlets.

22. A surge tank apparatus for receiving a flow comprising coolant from a radiator and from an engine of a vehicle, the apparatus comprising:

first, second, and third chambers coupled together so as to permit the flow of coolant through said first, second and third chambers and into the coolant reservoir;

the first chamber comprising at least one first chamber coolant inlet coupled to the radiator and the engine for receiving coolant from the radiator and from the engine, the first chamber comprising at least one first chamber outlet from which coolant is delivered from the first chamber;

the second chamber comprising at least one second chamber inlet coupled to the at least one first chamber outlet for receiving coolant passing through the first chamber, the second chamber comprising at least one second chamber outlet from which coolant is delivered from the second chamber;

the third chamber comprising at least one third chamber inlet coupled to the at least one second chamber outlet for receiving coolant passing through the second chamber, the third chamber comprising at least one third chamber outlet from which coolant is delivered from the third chamber;

the coolant reservoir comprising at least one reservoir receiving inlet coupled to the at least one third chamber outlet for receiving coolant passing through the third chamber, the coolant reservoir comprising at least one reservoir outlet for coupling to the engine through which coolant is returned to the engine from the coolant reservoir;

wherein the at least one first chamber outlet has a cross-sectional area sized to restrict the flow of coolant through the first chamber such that when the at least one first chamber inlet is coupled to an engine and a radiator, the first chamber and at least one first chamber inlet is filled with coolant so that coolant flows into the first chamber through the at least one first chamber coolant inlet into a pool of coolant in the first chamber; and wherein the coolant reservoir has a top portion and wherein the at least one third chamber outlet is at an upper region of the third chamber and is adjacent to the top portion of the coolant reservoir; and wherein the at least one second outlet and the at least one third outlet are positioned such that at least a majority of the coolant flows upwardly and away from the second chamber as coolant passes through the third chamber when the at least one inlet is receiving coolant.

23. A surge tank apparatus for receiving a flow comprising coolant from a radiator and from an engine of a vehicle, the apparatus comprising:

first, second, and third chambers coupled together so as to permit the flow of coolant through said first, second and third chambers and into the coolant reservoir;

the first chamber comprising at least one first chamber coolant inlet coupled to the radiator and the engine for receiving coolant from the radiator and from the engine, the first chamber comprising at least one first chamber outlet from which coolant is delivered from the first chamber;

the second chamber comprising at least one second chamber inlet coupled to the at least one first chamber outlet for receiving coolant passing through the first chamber, the second chamber comprising at least one second chamber outlet from which coolant is delivered from the second chamber;

the third chamber comprising at least one third chamber inlet coupled to the at least one second chamber outlet for receiving coolant passing through the second chamber, the third chamber comprising at least one third chamber outlet from which coolant is delivered from the third chamber;

the coolant reservoir comprising at least one reservoir receiving inlet coupled to the at least one third chamber outlet for receiving coolant passing through the third chamber, the coolant reservoir comprising at least one reservoir outlet for coupling to the engine through which coolant is returned to the engine from the coolant reservoir;

wherein the at least one first chamber outlet has a cross-sectional area sized to restrict the flow of coolant through the first chamber such that when the at least one first chamber inlet is coupled to an engine and a radiator, the first chamber and at least one first chamber inlet is filled with coolant so that coolant flows into the first chamber through the at least one first chamber coolant inlet into a pool of coolant in the first chamber;

wherein the coolant reservoir has a top portion and wherein the at least one third chamber outlet is at an upper region of the third chamber and is adjacent to the top portion of the coolant reservoir; and wherein the first, second and third chambers are of progressively increasing volumes.

* * * * *